US005133499A

United States Patent [19]

Schneider

[11] Patent Number: 5,133,499

[45] Date of Patent: Jul. 28, 1992

[54] ROTARY ATOMIZER WITH TURBINE MOTOR

[75] Inventor: Rolf Schneider, Burgstetten, Fed. Rep. of Germany

[73] Assignee: Behr Industrieanlagen GmbH & Co., Fed. Rep. of Germany

[21] Appl. No.: 166,208

[22] Filed: Mar. 10, 1988

[30] Foreign Application Priority Data

Mar. 23, 1987 [DE] Fed. Rep. of Germany ... 8704300[U]

[51] Int. Cl.[5] ..... B05B 3/02

[52] U.S. Cl. ..... 239/104; 239/223; 239/288.5

[58] Field of Search ..... 239/104, 120, 223, 288, 239/288.3, 288.5

[56] References Cited

U.S. PATENT DOCUMENTS

| | | | |
|---|---|---|---|
| 1,640,418 | 8/1927 | Marr | 239/223 |
| 3,043,521 | 7/1962 | Wampler | 239/223 |
| 3,144,209 | 8/1964 | Griffiths | 239/223 X |
| 4,312,907 | 1/1982 | Hiraoka et al. | 428/507 X |
| 4,555,058 | 11/1985 | Weinstein et al. | 239/223 |

*Primary Examiner*—Andres Kashnikow

*Attorney, Agent, or Firm*—Reising, Ethington, Barnard, Perry & Milton

[57] ABSTRACT

The outer surface of a turbine-housing (2) of an air-driven rotary atomizer for coating workpieces electrostatically is surrounded by a cover (5) made of a three-dimensional material permeable to air, whereby the formation of condensation-water upon the turbine-housing can be avoided.

8 Claims, 2 Drawing Sheets

ROTARY ATOMIZER WITH TURBINE MOTOR

The subject invention relates to a turbine driven rotary atomizer for coating workpieces in series with paint, the atomizer including an air permeable cover surrounding the turbine housing.

BACKGROUND ART

In the case of known rotary atomizers of this kind, as shown in prior art references German OS 30 01 209 and German OS 31 29 075, which are used for coating motor-vehicle bodies among other things, the turbine-housing and the connecting supply and exhaust conduit elements thereof are subject to considerable temperature drop by the expanding process of the air-turbine, especially in the case of an efficient turbine unit operating at high rpm. The frequently warm and moist ambient air in the spray-booth can therefore lead to the formation of condensate upon the surfaces of the turbine-housing and also upon the conduit elements connected thereto. This is highly undesirable, mainly because the dripping condensation-water may reach the paint being sprayed, thereby spoiling the integrity of the paint coating.

In order to counteract the formation of the condensate, the prior art has taught to heat the air driving the turbine, but this is inadequate as it requires a considerable amount of power. The prior art has also taught to provide a large plastic or metal cover about the whole atomizer housing, but this is deficient in that it would lead to structural and rheological problems. Moreover the exterior surface of the cover, above all, would be subject to condensate formation.

SUMMARY OF THE INVENTION AND ADVANTAGES

The subject invention relates to a rotary atomizer for serially coating workpieces with paint. The atomizer comprises a turbine-motor driven by a fluid such as air for rotating a spraying bell. The turbine-motor has a turbine-housing and a supply-line to the housing. The turbine-housing has an outer surface and an outer chamber and outlet apertures through which the expanded drive fluid flows to the outer chamber of the turbine-housing. The atomizer is characterized by including a cover made of a three-dimensional material through which air may permeate, the outer chamber and the outer surface being at least partially surrounded by the cover.

The subject invention provides a rotary atomizer with protection from condensation-water which requires a minimal expenditure on power and construction.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

The subject invention per se requires no additional source of power and has no structural and, above all, no rheological disadvantages. In certain conventional rotary atomizers, one end of an air permeable cover according to the subject invention may bear sealingly against the atomizer-housing, thus substantially forming an air-chamber around outlet-apertures for the waste-air from the turbine. The continuous flow of waste-air produces a slight overpressure and thus a uniform air-cushion around the essential part of the atomizer-housing. This air-cushion prevents direct contact between the warm, moist air in the spray-booth and the atomizer-housing which may be cooled to about 0 to +3° C. for example. In the case of rotary atomizers of other designs, it may be desirable to cover only the outer surface of the atomizer-housing or at least the parts thereof which are cooled. In a similar manner, the permeability of the cover to air prevents condensate from forming thereupon.

Figure 1:
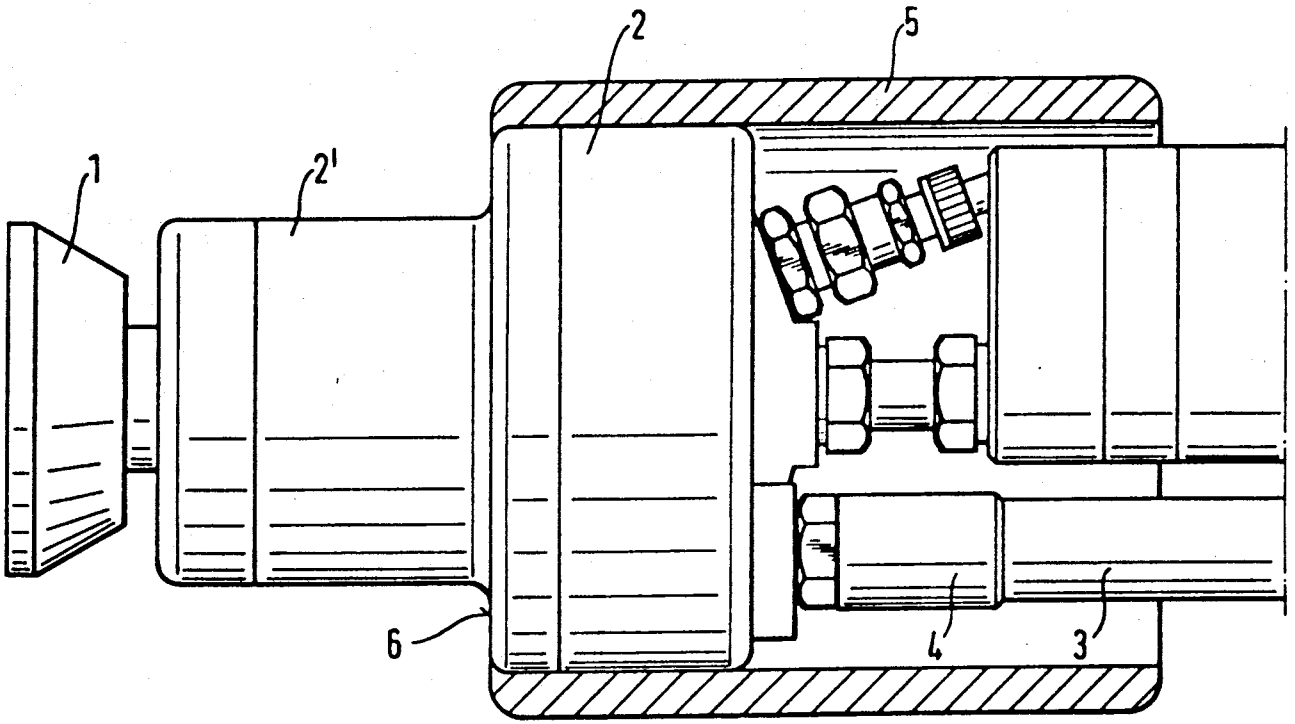
FIG. 1 is a side view of the preferred embodiment of the subject invention shown in partial cross section.

The subject invention is explained in greater detail in conjunction with the exemplary rotary atomizer shown in FIG. 1.

A spraying bell 1 of the atomizer is driven by an air-turbine disposed in cylindrical housing 2 to rotate at high rpm. Located in an extension 2' of the housing 2, at the end thereof adjacent the spraying bell 1, are bearings for a hollow shaft extending therethrough. Located at the other end of the housing 2 is a compressed-air supply-line 3 for the turbine and a waste-air cap 4, from the end of which expanded air from the turbine escapes to the environment. The supply-line 3 and the waste-air cap 4 are separate and distinct members arranged one behind the other at right angles to the plane of the drawing in FIG. 1.

The subject invention is characterized by including a cylindrical jacket-like cover 5, one end of which (shown as the left-hand end of FIG. 1) is secured and sealed to the turbine-housing 2, while the remainder, projecting axially from the turbine-housing 2, encloses an area containing the aforesaid connecting elements, the waste-air cap 4, and a part of the compressed-air supply-line 3. At one end of the cover 5 (shown as the right-hand end in FIG. 1) which is open in the axial direction, waste-air emerging from the waste-air cap 4 may escape to the environment without obstruction.

The cover 5 must be three-dimensionally, i.e., in each direction, permeable to air. It may, with advantage, be made from an adequately porous, for example foamed, plastic having good hydrophobic, i.e. water-repellant, properties. Suitable synthetic materials for the purpose, having a total pore-volume of between 40 and 50% for example, are available commercially, such as that marketed under the trademark "Filtroplast."

Alternatively, a three-dimensional, air-permeable, ceramic material or a metal structure, for example in the form of a wire or fibre netting may be used. Additionally, a tubular, and possibly flexible, textile material, preferably made of plastic may be secured to the turbine-housing 2 and stabilized, i.e., supported in its cylindrical shape, by slight overpressure in the enclosed area.

Figure 2:
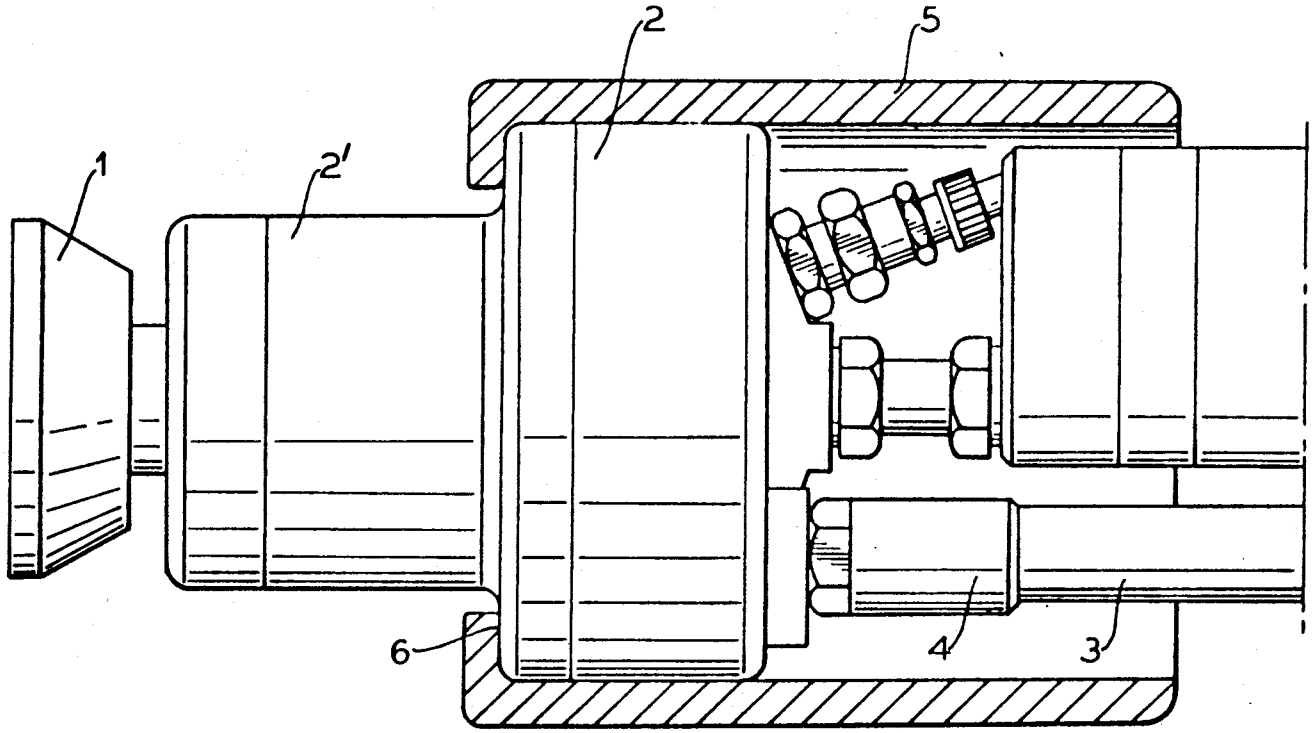
FIG. 2 is a side view of an alternative embodiment of the subject invention.

A modification, as shown in FIG. 2, of the foregoing description of the preferred embodiment comprises a one-piece radially inward extension of the cover 5, or a separate, three-dimensional, air-permeable part secured to a cylindrical element similar in shape to the cover 5 and forming the outer surface thereof, engaging over an end surface 6 of the turbine-housing 2 and covering at least a substantial part of the end-surface 6 adjacent the spraying bell 1. A further embodiment may comprise a separate covering part, made of a thermally insulating material. The separate covering part may extend around the end surface 6 of the turbine-housing 2 and form a front end-surface. The separate covering part may be fitted to the porous cover 5, however, the separate covering part must not be porous.

If the atmospheric humidity is extremely high, it may be desirable to protect against the formation of condensation-water by ventilating the affected exposed areas with treated, i.e. dry, air. Under normal circumstances, however, a blowing device for blowing dry air is unnecessary, as the blowing device and its power consumption are costly.

According to a modified example of embodiment (not shown), a free air-gap may be provided between the inside of porous cover 5 and the outside of the turbine-housing 2. This air-gap surrounds substantially the whole of the housing 2 and a line for the injection of air opens thereinto The cover 5 fitted to the housing 2 may rest upon the lateral edges of the gap.

Still another alternative embodiment comprises a porous cover 5 inserted between the turbine-housing 2 and an external housing being made of a synthetic insulating material such as PTFE (polytetrafluorethylene).

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A rotary atomizer for serially coating workpieces, said atomizer comprising a turbine-motor driven by a fluid such as air for rotating a spraying bell (1), said turbine-motor having a turbine-housing, a supply-line (3) to said turbine-housing (2), said turbine-housing having an outer surface and an outer chamber and waste-air cap (4) through which the expanded drive fluid flows to said outer chamber of said turbine-housing (2), said atomizer characterized by including a cover (5) made of a three-dimensional material through which air may permeate, said outer chamber and said outer surface at least partially surrounded by said cover (5).

2. A rotary atomizer as set forth in claim 1 further characterized by said cover (5) comprising a tubular element fitting closely about said outer surface of said turbine-housing (2) and extending around the entire periphery thereof and extending axially of said turbine-housing (2) remote from said spraying bell (1) and having an open free end.

3. A rotary atomizer as set forth in either of claims 1 or 2 wherein said turbine-housing (2) includes a perpendicular end surface (6) adjacent said spraying bell (1), further characterized by said cover (5) comprising a part extending radially inwardly along said end-surface (6) of said housing (2).

4. A rotary atomizer as set forth in claim 1 further characterized by said cover (5) comprising a synthetic element having pores of a predetermined total volume extending therethrough.

5. A rotary atomizer as set forth in claim 1 further characterized by said cover (5) comprising a ceramic element having pores of a predetermined total volume extending therethrough.

6. A rotary atomizer as set forth in claim 1 further characterized by said cover (5) being fabricated of metal having pores of a predetermined total volume extending therethrough.

7. A rotary atomizer as set forth in claim 1 further characterized by said cover (5) being fabricated of a textile material having pores of a predetermined total volume extending therethrough.

8. A rotary atomizer as set forth in any one of claims 4, 5, 6, or 7 wherein said cover (5) occupies a predetermined volume in space further characterized by the total volume of said pores extending through said cover (5) amounting to approximately 40% of said predetermined cover (5) volume.

* * * * *